United States Patent [19]

Reed

[11] Patent Number: 4,532,987

[45] Date of Patent: Aug. 6, 1985

[54] GEOTHERMAL EXPANSION SPOOL PISTON

[76] Inventor: Lehman T. Reed, 3505 Chester Ave., Bakersfield, Calif. 93301

[21] Appl. No.: 581,794

[22] Filed: Feb. 21, 1984

[51] Int. Cl.[3] ..... E21B 33/03

[52] U.S. Cl. ..... 166/75.1; 166/85; 166/88; 285/138; 285/348

[58] Field of Search ..... 166/75 R, 88, 86, 85, 166/84; 285/139-141, 143-146, 351, 315, 138, 348

[56] References Cited

U.S. PATENT DOCUMENTS

| | | | |
|---|---|---|---|
| 2,080,271 | 5/1937 | Hirst | 285/348 |
| 2,315,134 | 3/1943 | Roach et al. | 285/144 |
| 2,426,371 | 8/1947 | Penick | 285/146 |
| 3,051,513 | 8/1962 | Watts et al. | 285/146 |
| 3,090,640 | 5/1963 | Otteman et al. | 285/145 |
| 3,976,130 | 8/1976 | Shambless et al. | 166/84 |
| 4,390,063 | 6/1983 | Wells, Jr. | 266/88 X |
| 4,416,472 | 11/1983 | Fowler et al. | 166/88 X |

*Primary Examiner*—James A. Leppink
*Assistant Examiner*—Hoang C. Dang
*Attorney, Agent, or Firm*—William C. Babcock

[57] ABSTRACT

A packing supporting piston assembly removably securable to an end section of a production casing of a geothermal well, which end section is disposed above a well head. The piston assembly when so mounted has packing in abutting sealing contact with the end section of the production casing and also has packing that is in slidable sealing contact with the interior surface of the expansion spool. The piston assembly is of such structure that the pressures exerted by the packing on the end section of the casing and on the interior surface of the expansion spool are independently adjustable to desired magnitudes. The degree of pressure exerted by the packing on the interior surface of the expansion spool is adjustable after the packing has been disposed within the confines of the spool. The piston assembly in a preferred form includes a circumferentially extending high temperature resisting grease seal situated within the confines of the piston assembly. In addition to the preferred form of the piston assembly, alternate forms of the piston assembly are provided, each of which permits the pressure exerted by the packing on the interior surface of the expansion spool to be adjusted to a desired magnitude and periodically varied as the same becomes necessary to maintain an effective seal.

12 Claims, 24 Drawing Figures

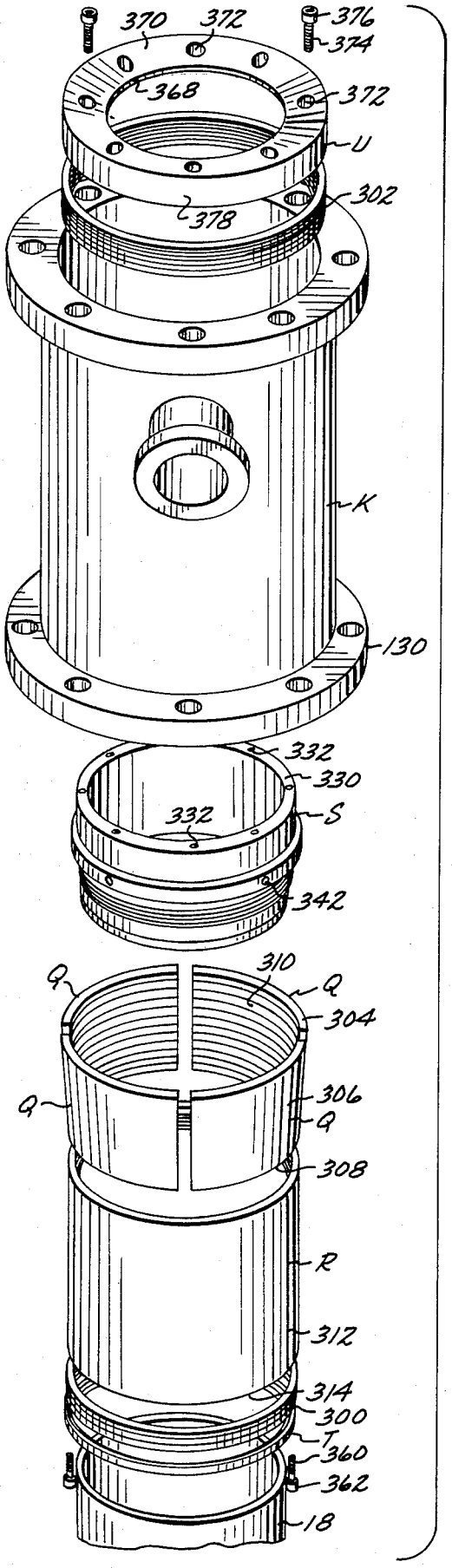
FIG. 18
FIG. 19
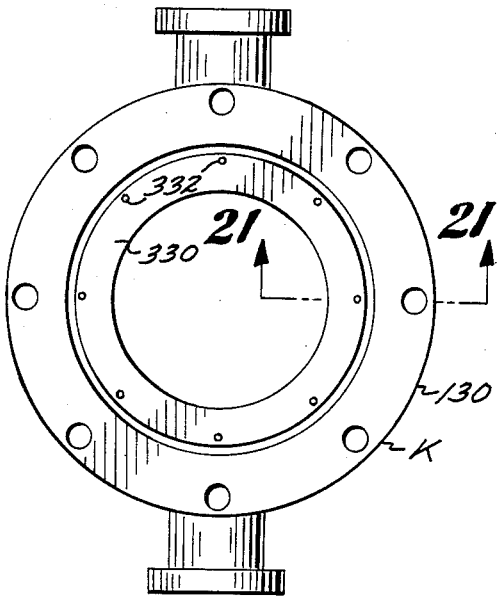
FIG. 20
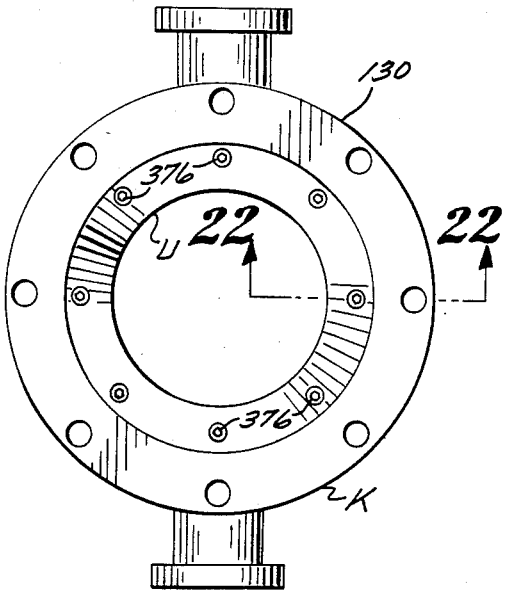

GEOTHERMAL EXPANSION SPOOL PISTON

BACKGROUND OF THE INVENTION

In a conventional geothermal well the production casing terminates in an end portion situated within an expansion spool, which spool is mounted on the upper end of a well head. The end portion of the casing tends to move longitudinally relative to the interior surface of the expansion spool as the production casing expands and contracts due to variations in the temperature to which it is subjected.

In the past, a sliding seal has been effected between an end portion of casing and the expansion spool in which it is disposed by a group of ring shaped packers that encircle the end portion and are positioned between two rigid metallic rings that occupy fixed positions on the casing end portion. The two rings are secured to the end portion of the casing by bolts or the like. Such a sealing structure is shown in the Shambless and Freeman U.S. Pat. No. 3,976,130 that issued Aug. 24, 1976 and is entitled "Packing Means For A Well Head Assembly". A seal such as shown and described in the above identified patent has the operational disadvantage that the pressure exerted by the packers on the interior surface of the expansion spool cannot be varied as the packers wear due to rubbing contact with the interior surface of the expansion spool nor can the pressure that the packers exert on the interior surface of the expansion spool be adjusted when the packers are disposed therein.

A major object of the present invention is to supply a piston assembly that may be removably secured to the end section of a casing string of a geothermal well with the pressure exerted by the packing that forms a part of the piston assembly being adjustable to a desired magnitude on the interior surface of the expansion spool after the packing is situated within the expansion spool. The pressure exerted by the packing may subsequently be adjusted when the expansion spool is lifted a short distance upwardly from the well head on which it is removably mounted.

Yet another object of the invention is to supply a piston assembly in which in a preferred form thereof first and second packings that form a part of the assembly may be adjusted individually to exert desired pressures on the exterior surface of the casing and the interior surface of the expansion spool.

A further object of the invention is to furnish an expansion spool piston that may be made up and secured to casing of a geothermal well after the casing has been cut to extend into an expansion spool a desired distance, but with the use of a wrench, and without altering the structure of the casing end section or the expansion spool.

A still further object of the invention is to furnish a piston assembly that after mounting on an end section of casing may have high temperature resisting grease injected thereinto to provide a circumferentially extending seal.

These and other objects and advantages of the invention will become apparent from the following description of a preferred form thereof and certain alternate forms of the invention.

SUMMARY OF THE INVENTION

Production casing in a geothermal well is torque cut to have a end section of a desired length extend upwardly above a well head on which an expansion spool is to be mounted, with the free circular end surface of the casing end section being ground smooth, and the exterior side surface of the end section being smoothed by the use of emery or like material.

In removably mounting the piston assembly on the end section of the production casing, an internally threaded, wrench engageable, casing packing ring and internally threaded wrench engageable piston packing ring of larger diameter are moved downwardly over the casing end section to posions adjacent the well head. A number of high temperature packing rings of square transverse cross section are moved downwardly over the casing end section to rest on the casing packing ring. A chevron packing assembly is moved downwardly over the casing end section and rests on the upper portion of the piston packing ring.

A shouldered cylindrical interior shell that has a first downwardly and inwardly extending cam surface on the exterior thereof and spaced prongs on the interior surface is threadedly connected to an outer cylindrical shell. The outer shell has a second cam surface that is rotatable sliding contact with the first cam surface, with the outer shell having a lower end portion on which internal and external threads are defined. The internal and external threads are engageable by the threads on the casing and piston packing rings.

The outer shell has a body shoulder that extends inwardly and is situated below the second cam surface, as well as an outwardly extending body shoulder.

The interior and outer cylindrical shells are slipped downwardly over the end section of the casing as a unit, with the outer shell then being rotated to cause relative movement between the first and second cam surfaces. Such relative movement forces the prongs into gripping contact with the external surface of the casing end section to removably secure the interior shell and outer shell in a fixed position thereon.

The casing packing ring and high temperature square packings are now moved upwardly on the casing. The casing packing ring is now rotated by a spanner wrench, with the threads on the casing packing ring being in engagement with the internal threads on the outer shell. Continued rotation of the casing packing ring results in the square packing being compressed between the casing packing ring and the inwardly extending body shoulder on the outer shell. As the square packing is compressed longitudinally, the square packing expands radially to pressure contact both the external surface of the casing end section and the internal surface of the outer cylindrical shell. Rotation of the casing packing ring is continued until the square packing is exerting a desired pressure on the external surface of the casing and internal surface of the outer shell.

The same procedure is performed on the piston packing ring to move it upwardly relative to the outer shell and place a slight amount of compression on the chevron packing assembly.

An expansion spool is now lowered relative to the well head to envelop all of the piston assembly except spanner wrench openings in the piston packing ring. The piston packing ring is now further rotated to compress the chevron packing until the latter radially expands to exert a desired sealing pressure on the interior surface of the expansion spool. The expansion spool is now moved downwardly to rest on the well head and removably secured thereto by bolts or the like.

In addition to the preferred form of the packing assembly as above described, certain alternate forms thereof are provided in which the piston assemblies are removably secured to the end section of production casing, and by manually manipulating components of the assemblies the packing may be radially expanded to pressure seal with the interior surface of the expansion spool after being disposed in the latter.

BRIEF DESCRIPTION OF THE DRAWINGS

FIG. 18 is an exploded perspective view of the end section of production casing, and a second alternate form of piston assembly that is removably securable thereto, and the expansion spool with which the piston assembly will effect a slidable pressure seal;

FIG. 19 is a top plan view of a portion of the second alternate form of piston assembly disposed within the expansion spool;

FIG. 20 is a top plan view of the expansion spool after the same has been completely assembled within the expansion spool to effect slidable sealing contact with the interior surface thereof;

DESCRIPTION OF THE PREFERRED EMBODIMENTS

Figure 1:
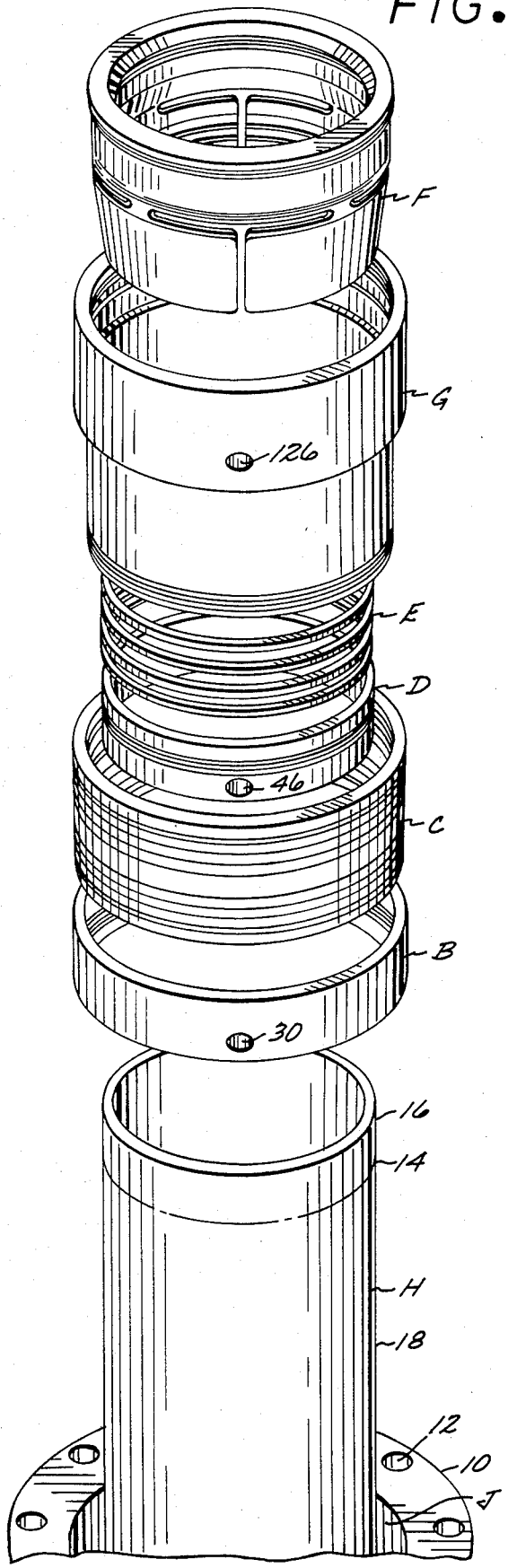
FIG. 1 is an exploded perspective view of a preferred form of the piston assembly situated above an end section of production casing on which the piston assembly will subsequently be mounted, and which end section projects above a well head.

A preferred form A of the piston assembly is shown in FIG. 1 in exploded perspective. The piston assembly A includes a metallic casing packing ring B that supports a number of high temperature resisting packing rings C thereabove. Also included in the piston assembly A is a piston packing ring D that has a high temperature resistent packing E situated thereabove. Further included in the piston assembly A is an interior force receiving, cam surface, defining cylindrical mounting shell F that is in threaded enveloping engagement with an outer force transmitting, cam surface, defining outer shell G, both of which shells are made from a suitable metallic material such as steel or the like.

Figure 4:
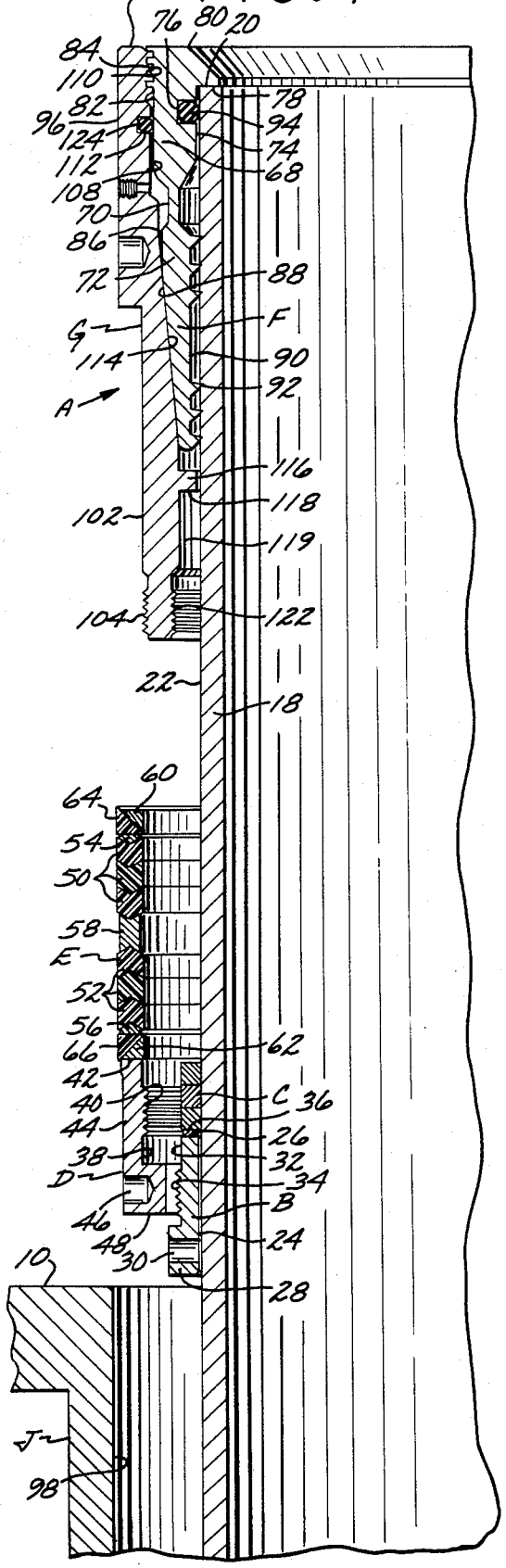
FIG. 4 is a cross sectional view of the piston assembly shown in FIG. 3 taken on the line 4—4 thereof in which the interior and outer cylindrical shells thereof are removably secured to an end section of the casing, with the casing and piston packing rings being disposed there below, and the high temperature square packing and the chevron packing assembly resting on the casing and piston packing rings.
Figure 5:
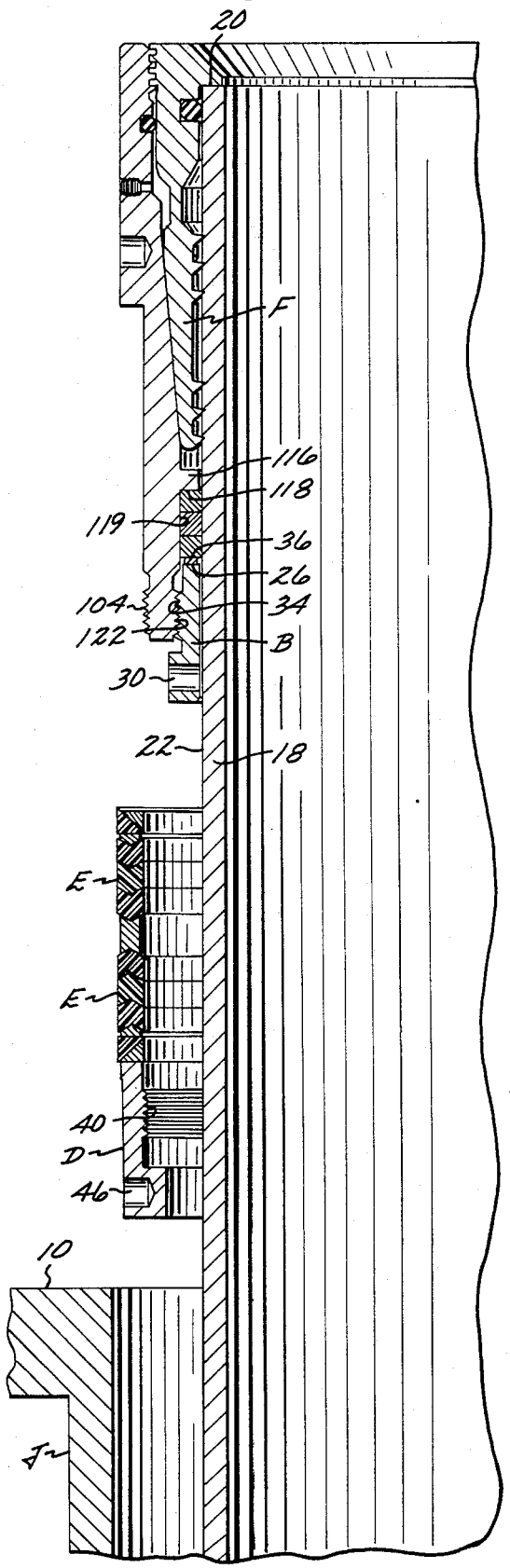
FIG. 5 is the same view as shown in FIG. 4 but with the casing packing ring and square packing having been moved upwardly, and the packing ring rotated when in threaded engagement with the outer shell to longitudinally compress the square packing and radially expand the same into sealing contact with the exterior surface of the casing end section and interior surface of the outer shell with a desired magnitude of pressure.

The piston assembly A is used in conjunction with a production casing string H of a geothermal well (not shown), which well has a well head J as a part thereof. The well head J includes a flange 10 that extends outwardly thereof and has a number of circumferentially spaced bolt holes 12 therein. The casing H extends upwardly above the well head J and is torque cut along the phantom line 14 shown in FIG. 1, with the portion 16 of the casing above the phantom line being removed from the casing string. By this cutting operation, an end section 18 of the casing above the flange 10 is provided that is of a desired height. The circumferential edge 20 of the end section 18 is ground to a smooth finish as shown in FIGS. 4 and 5, as is the outer exterior surface 22 of the casing end section 18.

Figure 2:
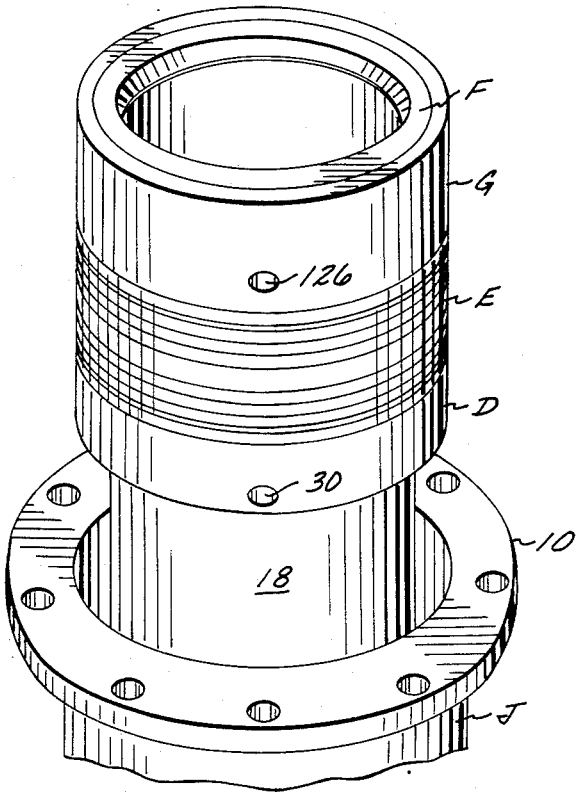
FIG. 2 is a perspective view of the piston assembly after it has been removably secured to an end section of the production casing that projects above the well head.
Figure 3:
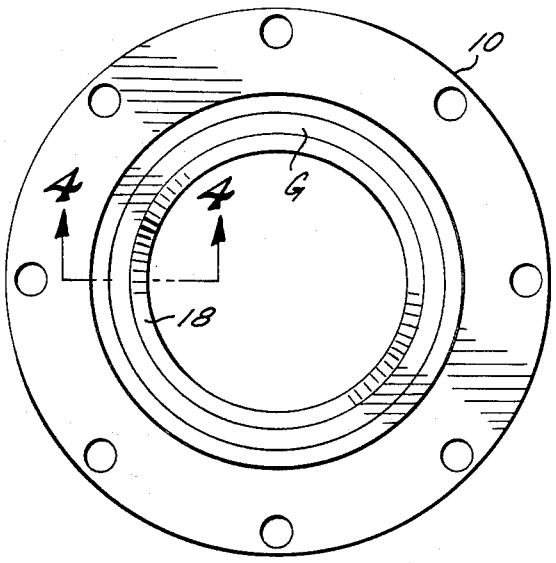
FIG. 3 is a top plan view of the piston assembly shown in FIG. 2.

In FIG. 2 the components above described are shown in an assembled form to provide the piston assembly A that is removably secured to the end section 18 of the casing string H.

The casing packing ring B is formed from metal such as steel, and includes an interior cylindrical surface 24 of such diameter that the packing ring may be slid longitudinally on the outer surface 22 of the end section 18. In FIG. 4 the packing ring B is shown in a downwardly disposed position on the casing end section 18 adjacent the well head J. The casing packing ring B includes a flat top surface 26 and a bottom portion 28. The bottom portion 28 has a number of circumferentially spaced transversely extending wrench engageable openings 30 therein. The casing packing ring B has an outer cylindrical surface 32 on which first threads 34 are formed as shown in FIG. 4. A number of the high temperature resisting packing rings C are mounted on the casing end section 18, with each of the packing rings being of square transverse cross section, and the group of packing rings resting on the casing packing ring B as shown in FIG. 4.

Figure 7:
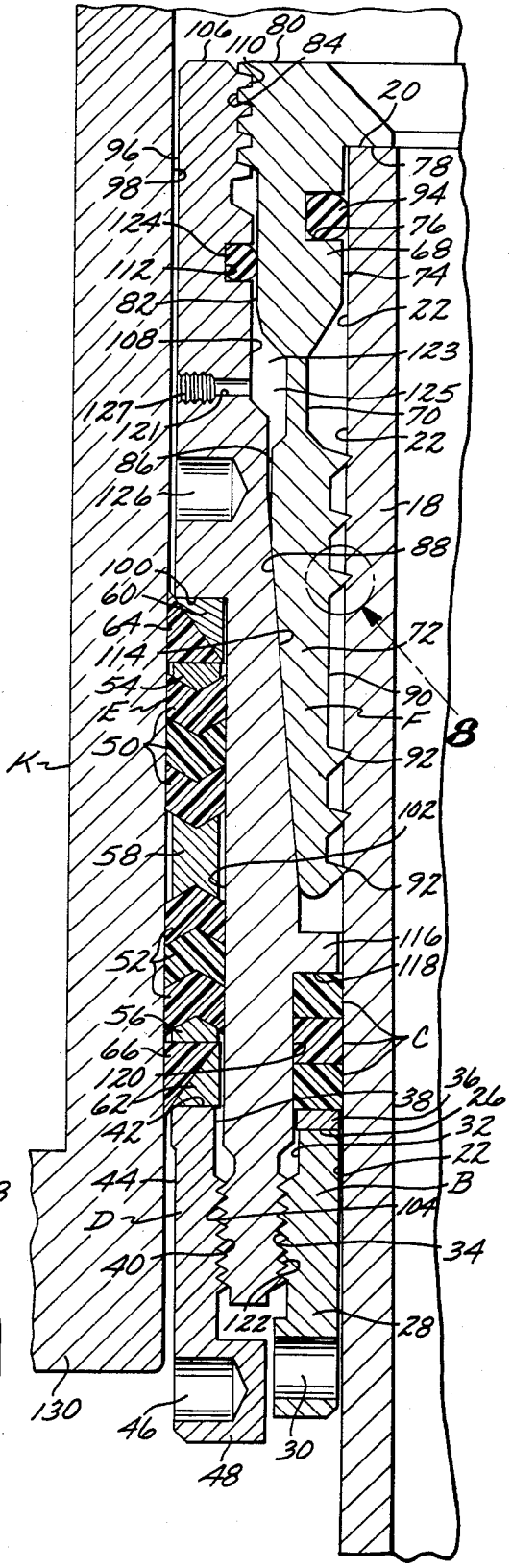
FIG. 7 is an enlarged longitudinal cross sectional view of the piston assembly mounted on the end section of the casing, and illustrating the means for effecting a high temperature grease seal between the interior shell and outer shell.
Figure 8:
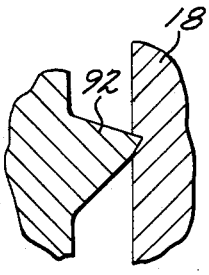
FIG. 8 is a fragmentary view of one of the prongs situated within the circle shown in phantom line in FIG. 7 and in gripping contact with the external surface of the end section of casing.

The piston packing ring D as may be seen in FIG. 7 is of larger diameter than the casing packing ring B, and extends there around. The piston packing ring D includes an interior cylindrical surface 38 that has second threads 40 formed in an intermediate position thereon, with the packing ring including a flat upper end surface 42. The packing ring D also includes an outer cylindrical surface 44 which in the lower portion thereof has a number of circumferentially spaced spanner wrench engageable cavities 46 extending inwardly therefrom into a portion 48 of the piston packing ring D that is of increased thickness.

The packing E is defined by an upper group 50 of high temperature resistent chevron packing rings and lower group 52 of the same type of packing rings. Upper, lower and intermediately disposed steel adapter rings 54, 56 and 58 are in abutting contact with the groups of upper and lower packing rings 50 and 52. Upper and lower steel pressure rings 60 and 62 are in abutting contact with upper and lower resilient packing rings 64 and 66 of triangular transverse cross section, with the packing rings 64 and 66 in contact with adapter rings 54 and 56, as shown in FIG. 7.

The interior force receiving shell F as best seen in FIG. 7 includes an upper cylindrical portion 68 of substantial thickness that develops on the lower end into a thin wall section 70, from which a lower portion 72 of substantially greater thickness than the section 70 depends. The upper cylindrical portion has an internal cylindrical surface 74 of slightly larger diameter than that of the external surface 22 of end section 18. Surface 74 has a circumferentially extending recess 76 formed therein. Recess 76 extends outwardly relative to the end section 18 as may be seen in FIG. 7.

The upper portion 68 has a body shoulder 78 formed therein that may be placed in abutting contact with the upper end surface 20 of the end section 18 when the force receiving shell F is slid downwardly over the end section. The upper cylindrical portion 68 includes a flat ring shaped top surface 80 and an external cylindrical surface 82, which last mentioned surface in the upper portion thereof has third threads 84 defined thereon.

The lower portion 72 as shown in FIG. 7 includes a cylindrical external surface 86 from which a first frusto-conical cam surface 88 extends downwardly and inwardly as may be seen in FIG. 7. The lower portion 72 has an internal cylindrical surface 90 that is of greater diameter than the external surface 22 of end section 18, and the surface 90 having a number of longitudinally spaced, circumferentially extending prongs 92 projecting inwardly therefrom as shown in FIG. 7 that may be forced into engaging contact with the end section 18 when an inwardly directed force is exerted on the lower portion 72. The thin wall section 70 is sufficiently resilient as to permit the lower portion 72 to be moved inwardly relative to the upper portion 68.

A resilient packing ring 94 is disposed in the recess 76 and is in pressure sealing contact with the exterior surface 22 of end section 18 when the force receiving shell F is mounted on the end section as shown in FIG. 7.

The external force transmitting cylindrical shell G has an upper outer cylindrical surface 96 of slightly smaller diameter than the internal cylindrical surface 98 that extends upwardly through an expansion spool K that may be mounted on well head J. The cylindrical surface 96 on the lower end develops into an inwardly extending second body shoulder 100. A lower outer cylindrical surface 102 extends downwardly from the second body shoulder 100 and is of substantially less diameter than that of the interior cylindrical surface 98 in the expansion spool K. The lower portion of the cylindrical surface 102 has fourth threads 104 defined thereon as may be seen in FIG. 7.

The force transmitting cylindrical shell G includes an upper ring shaped end surface 106 as shown in FIG. 7 from which an upper interior cylindrical surface 108 extends downwardly, with the upper portion of the surface having fifth threads 110 formed thereon. A circular recess 112 is formed in the surface 108 as shown in FIG. 7. A second frusto-conical cam surface 114 extends downwardly and inwardly from the upper interior cylindrical surface 108 and is in slidable rotatable contact with the first cam surface 88 as shown in FIG. 7.

The second cam surface 114 terminates on the lower end in a circular rib 116 that extends inwardly, with the lower surface of the rib 116 providing a circumferentially extending body shoulder 118. A lower interior cylindrical surface 119 extends downwardly from the rib 116 and on the lower end develops into sixth threads 122 as shown in FIG. 7. The circumferentially extending recess 112 has a resilient ring 124 therein that is in pressure sealing contact with the external cylindrical surface 82.

Use and operation of the invention is extremely simple. The casing packing ring D and the high temperature resisting packing C are slid downwardly over the end section 18 of the production casing H to a position adjacent the well head J as shown in FIG. 4. The piston packing ring D together with the high temperature resistent packing C are moved downwardly over the casing end section 18 as shown in FIG. 4 adjacent to the casing packing ring B. The interior force receiving cylindrical shell F and the outer force transmitting shell G have the third threads 84 and fifth threads 110 placed in engagement to the extent that the shells F and G are held together as a unit, with the shells F and G then being moved downwardly over the end section 18 to dispose the body shoulder 78 in abutting contact with the upper end 20 of the casing section 18 as shown in FIG. 4.

Prior to this operation being carried out packing rings 94 and 124 are placed in the recesses 76 and 112. The outer force transmitting shell is now rotated in an appropriate direction relative to the force receiving shell F by a wrench (not shown) engaging cavity 46, and due to relative rotation of the fifth threads 110 relative to the third threads 84, the outer shell G moved upwardly relative to the inner shell F.

As this upward motion takes place the second cam surface 114 exerts an inwardly directed force on the first cam surface 88, and the lower portion 72 of the inner shell is forced inwardly for the prongs 92 to grip the external surface 22 of the casing end section 18 and removably secure both the inner and outer shells F and G thereto. The resilient ring 94 effects a fluid tight seal between the exterior surface 22 of end section 18 and the upper portion 68 of inner force receiving shell F.

The resilient sealing ring 124 likewise establishes a fluid tight seal between the exterior cylindrical surface 82 of the upper cylindrical portion 68 and the upper part of the outer cylindrical shell G. The cylindrical shells F and G are now removably supported in a fixed longitudinal position on the casing end section 18.

Casing packing ring B and the packing C are now moved upwardly to the position shown in FIG. 5, and the casing packing ring B rotated by a spanner wrench that engages the opening 30 to rotate the first threads 34 relative to the sixth threads 122. As such rotation takes place the casing packing ring B moves upwardly relative to the force transmitting shell G, with the packing C being longitudinally compressed between the washer 36 and body shoulder 118. This longitudinal compression of the packing C results in the packing being radially expanded into pressure sealing contact with both the external surface 22 of the casing end section 18, and the lower interior cylindrical surface 120 of the force transmitting cylindrical shell G.

Figure 6:
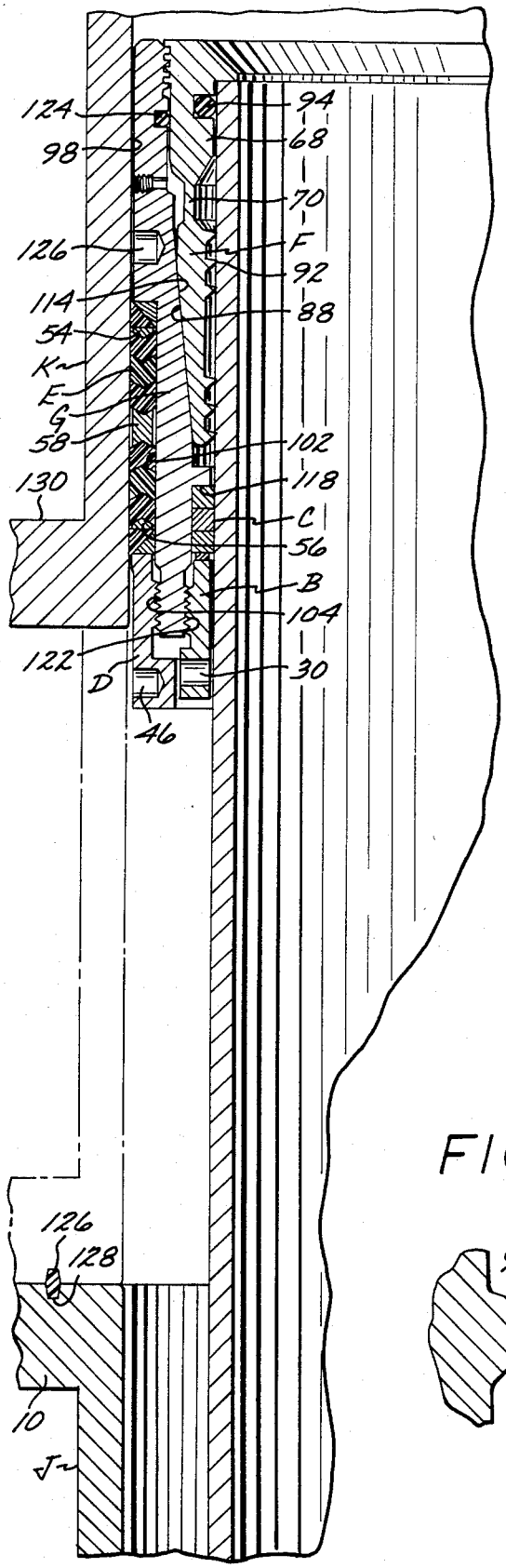
FIG. 6 is a longitudinally cross sectional view of the lower portion of the piston assembly after the piston packing ring and chevron packing assembly have been moved upwardly thereon, and the piston packing ring rotated to move upwardly to longitudinally compress the chevron assembly and radially expand the same into pressure sealing contact with the exterior surface of the outer cylindrical shell and a lower portion of the interior surface of an expansion spool with a desired magnitude of pressure.

The piston packing ring D when rotated by a wrench (not shown) engaging the cavity 46 causes the second threads 40 to rotate relative to the fourth threads 104 as may be seen in FIG. 7, and this rotation being continued until a slight compression is placed on the packing rings E. The expansion spool K is now lowered relative to the piston assembly A until the packing E is situated within the interior thereof as shown in FIG. 6, but not to the extent that the cavities 46 are covered. The piston packing ring D is now further rotated by causing a wrench (not shown) to engage the cavities 46, and the piston packing ring D moving upwardly to longitudinally compress the packing E and the packing rings 64 and 66 to expand radially into pressure sealing contact with the interior cylindrical surface 98 of the expansion spool K. By rotation of the piston packing ring D, the packing E may be caused to exert a desired pressure on the interior surface 98. After the desired pressure has been attained, the expansion spool K is lowered onto the well head J. Prior to this lowering a ring gasket 126 is placed in a groove 128 in the flange 10 as shown in FIG. 6. The lowering of the expansion spool is continued until the flange 130 thereof is in abutting contact with the gasket 126 with the flanges 10 and 130 then being removably secured together by bolts (not shown) that extend through the flange 130 and the bolt holes 12 in flange 10.

From the above described operation of the preferred from A of the piston assembly, it will be seen that the packing C may be forced into sealing contact with the external surface 22 of end section 18 with a desired magnitude of pressure, which pressure is independent of the pressure exerted by the packing E when in sliding contact with the interior surface 98 of the expansion spool K.

In FIG. 7 it will be seen that a transverse partially tapped bore 121 is formed in the upper portion of outer shell G that by the use of a grease gun (not shown) may be used to fill a circumferentially extending space 123 with a high temperature resisting grease 125 of jelly like consistency. The space 123 is defined between the thin wall section 70 and interior surface 108. The grease provides a seal between the cylindrical shells F and G. The grease 125 is discharged into space 123 prior to the piston A being disposed within expansion spool K. The tapped bore 121 is closed by an externally threaded plug 127 after grease 125 has been discharged into space 123.

Figure 9:
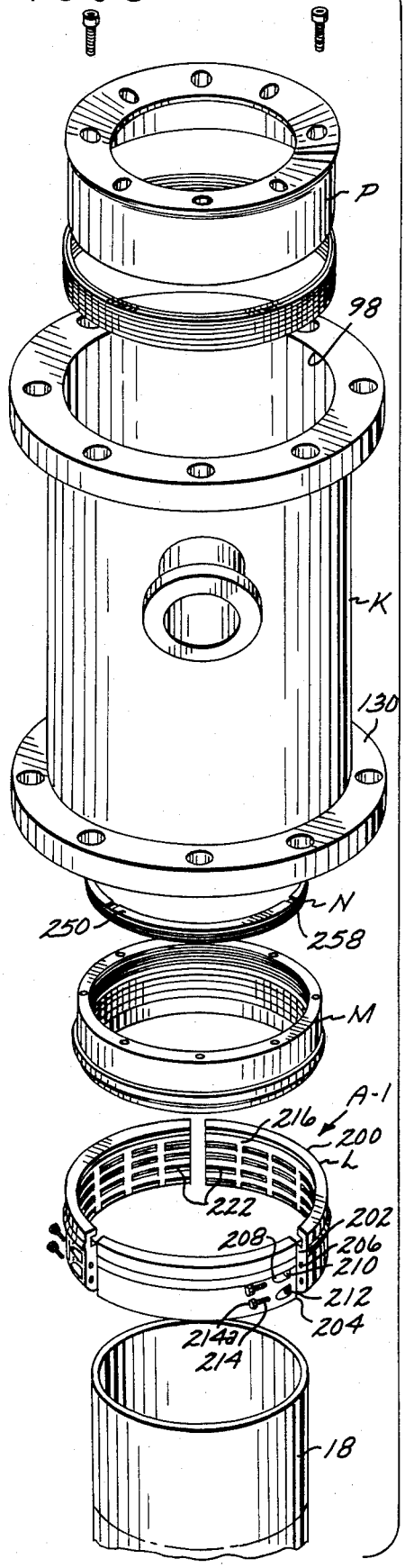
FIG. 9 is an exploded perspective view of a first alternate form of piston assembly that is removably securable to an end section of production casing, and when so secured capable of effecting a slidable seal with the interior surface of an expansion spool.

A first alternate form of piston assembly A-1 is shown in FIGS. 9 to 17 inclusive, which assembly is adapted to be removably secured to an end section 18 of casing H that projects upwardly above a well head J. The piston when so mounted on end section 18 is adapted to slidably and sealingly engage the interior surface 98 of an expansion spool K when the latter is mounted on well head J, which expansion spool is shown in FIG. 9.

The first alternate form of piston assembly A-1 as may be seen in FIG. 9 includes a mounting ring L, a force receiving ring M and first and second rigid force transmitting rings N and P. The first alternate form of piston assembly A-1 when mounted on an end section 18 of casing H performs the same function as the preferred form A of the piston assembly.

The mounting ring L as may best be seen in FIG. 9 is formed from a number of arcuate segments 200, each of which segments when the mounting ring L is disposed on an end section 18 has a first flat end surface 202 thereof in abutting contact with a second flat end surface 204 of the segment adjacent thereto. Each of the first flat end surfaces 202 have tapped cavities 206 extending inwardly therefrom. Each segment 200 has a number of vertically spaced circumferentially extending recesses 208 formed in the outer surface thereof adjacent the second end surface 204, which recesses terminate in abutment 210 from which bores 212 extend to the second flat end surface.

The segments 200 are mounted on the end section 18 by placing them in an encircling position thereon with the first and second end surfaces 202 and 204 in abutting contact. Screws 214 are extended through the bores 212 and rotated to engage the tapped recesses 206. When the screws 214 are rotated, the heads **214*a* thereof are drawn towards the abutment 210. Continued rotation of the screws 214 after the heads 214*a* bear against abutments 210 results in the segments 200 being drawn together. As the segments 200 are drawn together prongs 222 on the interior surfaces 216 thereof are forced into gripping contact with the external surface 22 of the end section 18**.

Figure 10:
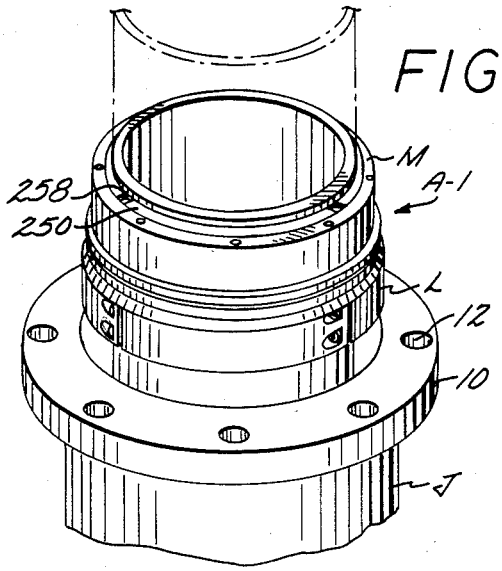
FIG. 10 is a perspective view of the first alternate form of piston assembly after being secured to an end section of casing.
Figure 11:
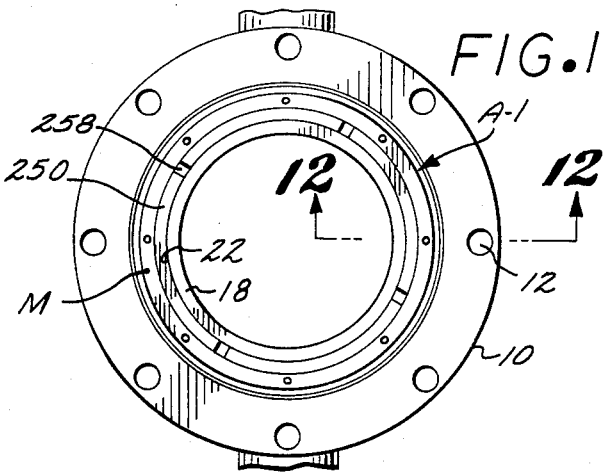
FIG. 11 is a top plan view of the first alternate form of piston after being secured to an end section of casing.

When all the screws 214 have been tightened, the mounting ring L occupies a fixed longitudinal position on the end section 18 as shown in FIG. 10. Each of the segments 200 has an exterior cylindrical surface 218, and each segment also includes an upper section 220 of inverted L shaped transverse cross section as may be seen in FIG. 12. The external surface 218 has a circumferentially extending prong 224 projecting therefrom, which prong serves to scrape deposited geothermal material from the interior surface 98 of the expansion spool K as the first alternate form of piston assembly A-1 moves upwardly and downwardly therein due to variations in temperature to which the casing H is projected.

The force receiving ring M which is formed from a rigid material such as steel includes a central portion 226 that has an interior cylindrical surface 228 slightly larger than the external surface 22 of the casing end section 18. The central portion 226 has an external cylindrical surface 230 that is slightly less in diameter than the diameter of the opening 98 defined in the expansion spool K. The central portion 226 has an upper end surface 232 which from substantially the center thereof a cylindrical shell 234 extends upwardly a substantial distance. The cylindrical shell 234 has an interior cylindrical surface 236 of substantially greater diameter than that of the surface 22 of the casing end section 18.

The shell 234 has an external cylindrical surface 238 that is substantially less than the diameter of the interior surface 98 in the expansion spool K. The cylindrical shell 234 has an upper flat ring shaped end surface 240 that has a number of circumferentially spaced tapped recesses 242 extending downwardly into the shell therefrom. The central portion 226 has a circular section 244 of L shaped transverse cross section depending therefrom. The force receiving ring M is mounted on the end section 18 of the casing H and the segments 200 are then assembled in an encircling position on the end section, with the inverted L shaped upper section 220 interlocking with the lower section 244 of L shaped cross section as shown in FIG. 17.

Figure 17:
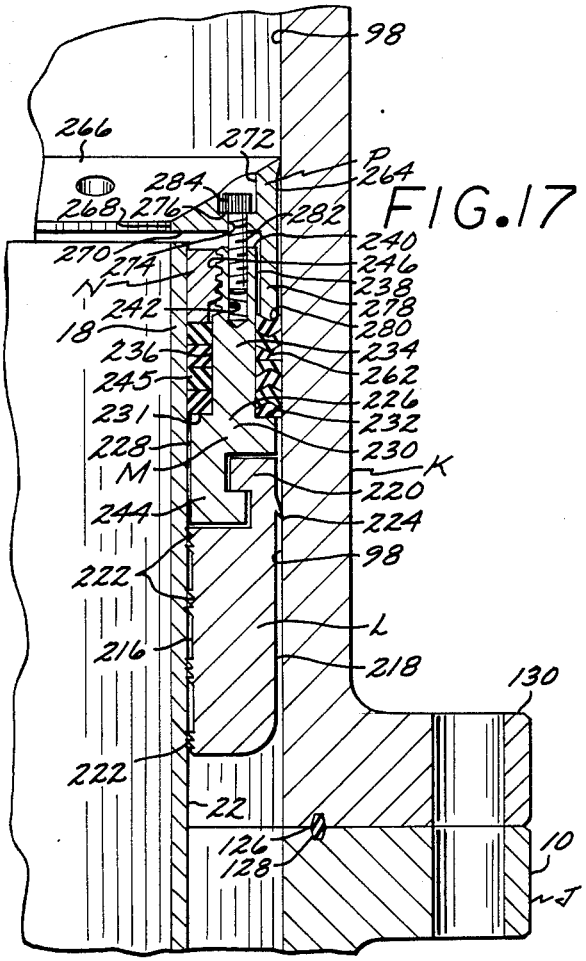
FIG. 17 is a longitudinal cross sectional view of the first alternate form of the piston assembly taken on the line 17—17 of FIG. 16.

When the screws 214 are tightened, the mounting ring L and the force receiving ring M are secured in a fixed longitudinal position on the end section 18 as shown in FIG. 17.

Figure 12:
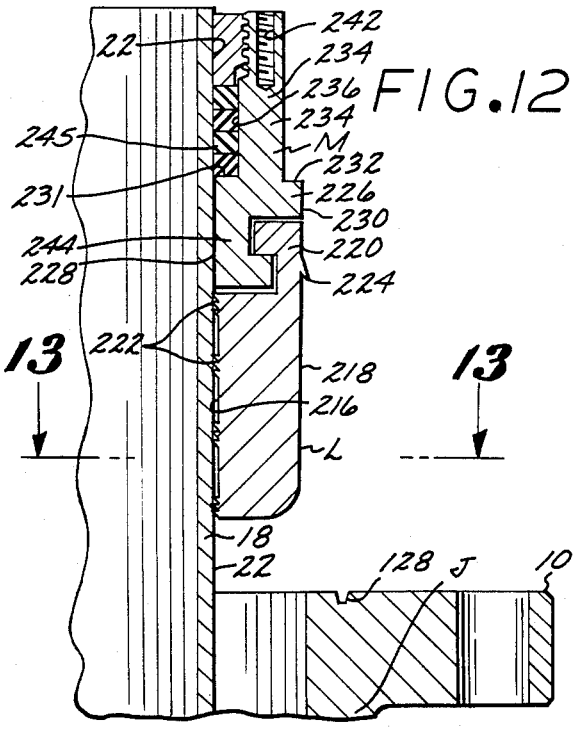
FIG. 12 is a longitudinal cross sectional view of the first alternate form of piston assembly on the line 12—12 of FIG. 11.
Figure 13:
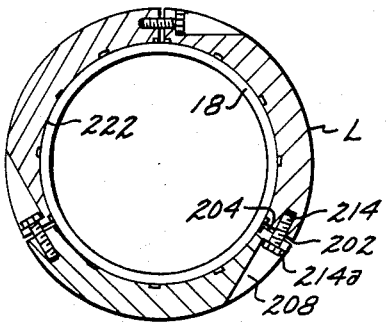
FIG. 13 is a transverse cross sectional view of the first alternate form of piston assembly taken on the line 13—13 of FIG. 12.
Figure 14:
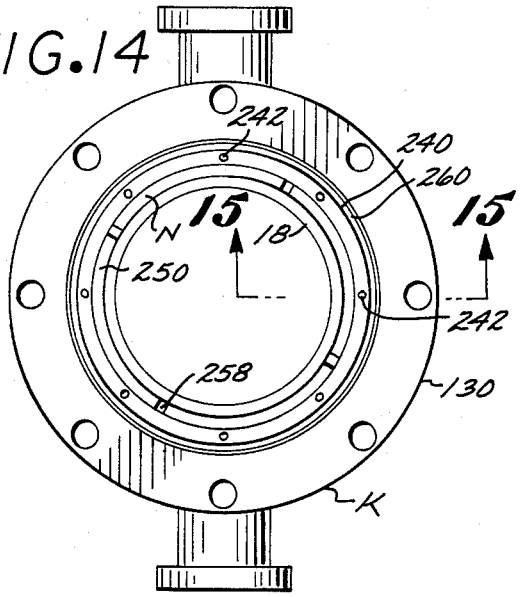
FIG. 14 is a top plan view of the first alternate form of piston assembly partially assembled within an expansion spool.
Figure 16:
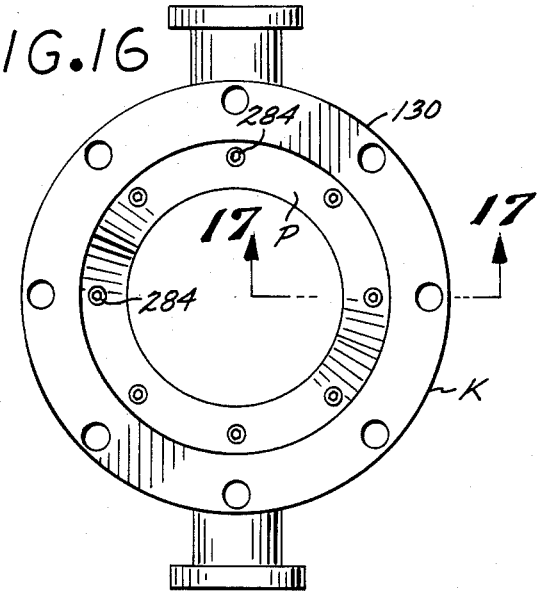
FIG. 16 is a top plan view of the first form of piston assembly completely assembled and disposed within an expansion spool.

With the mounting ring L and the force receiving ring M mounted on the end section 18 as shown in FIG. 12, a number of heat resistent packing rings 245 are slid downwardly on the end section 18, with the lowermost one of the packing rings resting on the upper surface 232. The packing rings 245 are of an internal diameter larger than the diameter of the external surface 22 of the end section 18.

The upper portion of the interior cylindrical surface 236 has first threads 246 formed thereon as may be seen in FIG. 17.

The first force transmitting ring N has an internal cylindrical surface 248, an upper end surface 250, lower end surface 252 and an outer cylindrical surface 254 that has second threads 256 formed thereon. In FIG. 9 it will be seen that the first force transmitting ring N has a number of circumferentially spaced openings 258 therein that extend downwardly therein from the upper end surface 250.

The openings 258 may be engaged by a suitable wrench (not shown) and the ring rotated in an appropriate direction to move downwardly due to relative movement between the first threads 246 and the second threads 256. Such rotation of the first force transmitting ring N takes place after the expansion spool K has been mounted on the well head J, and the flanges 10 and 130 removably secured together by bolts (not shown). As the first force transmitting ring N is rotated as above described, the group of first packing rings 245 are longitudinally compressed between the lower end surface 252 of ring N and the inner portion of the upper end surface 232, with the packing rings expanding radially into pressure sealing contact with the exterior surface 22 of the casing end section 18 and the inner cylindrical surface 236 of the cylindrical shell 234. Rotation of the ring N is continued until the packing rings 244 exert a desired pressure on both the cylindrical surface 22 and surface 236.

Figure 15:
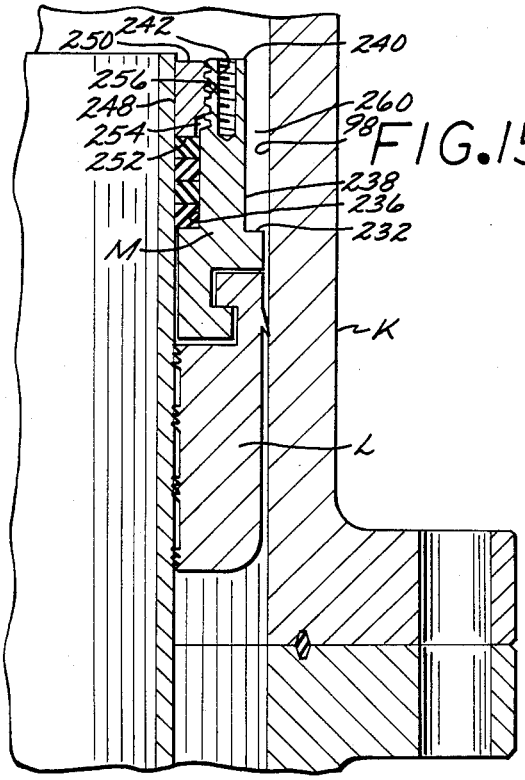
FIG. 15 is a longitudinal cross sectional view of the first alternate form of piston assembly taken on the line 15—15 of FIG. 14 and illustrating a scrapper that forms a part thereof that removes foreign material from the interior surface of the expansion spool.

In FIG. 15 it will be seen that an annulus space 260 is defined between the surfaces 98, 238 and 232. A group of high temperature resisting packing rings 262 is provided that have interior surfaces of a diameter slightly larger than the diameter of the outer cylindrical surface 238 of the shell 234, and outer surfaces of a diameter slightly less than that of the diameter of the interior surface 98 in the expansion spool K. The packing rings 262 are disposed in the annulus shaped space 260.

The second force transmitting ring P which is formed of steel or other rigid material has an outer cylindrical surface 264 that is of slightly smaller diameter than the diameter of the surface 98 in the expansion spool K. The ring P has a downwardly and inwardly sloping top surface 266 that develops into an inner cylindrical surface 268, and the ring including a flat bottom surface 270. A number of circumferentially spaced downwardly extending bores 272 are formed in the ring P and intersect counter bores 274 at their intersections define body shoulders 276. A cylindrical rib 278 of substantial length depends downwardly from the second force transmitting ring P. The rib 278 has a flat lower ring shaped end surface 280 as shown in FIG. 17.

After the first group of packing rings 245 have been forced into sealing contact with the casing end section 18, the second force transmitting ring P is moved downwardly through the expansion spool K to the position shown in FIG. 17 to place the lower end surface 280 of the rib 278 in abutting contact with the uppermost one of the group of second packing rings 262. The second force transmitting ring P is manually minipulated to align the bores 272 with the tapped bores 242. Screws 282 are now extended downwardly through the bores 272 to engage the tapped recesses 242, with the screws when rotated by heads 284 that form a part thereof forcing the ring P downwardly together with rib 278, to longitudinally compress the second group of packing rings 262 between the end surfaces 232 and 280, with the packing rings expanding radially and pressure sealing with the external cylindrical surface 238 of the shell 234 and the surface 98 in the expansion spool K. Rotation of the screws 262 is continued until the group of second packing rings 262 exerts pressure of a desired magnitude on the surface 98 of expansion spool K as well as the cylindrical surface 238.

From the above description, it will be seen that the first alternate from A-1 of the piston permits the first and second groups of packing rings 245 and 262 to be independently adjusted to exert desired sealing presures on the external surface 22 of the end section 18 of casing H, as well as the surface 98 of the expansion spool K after the expansion spool has been disposed on the well head J as shown in FIG. 17.

A second alternate form of piston assembly A-2 is shown in FIGS. 18 to 22 that is removably securable in sealing contact with the end section 18 of casing H, and when so mounted can effect sealing engagement with the cylindrical surface 98 in expansion spool K when the latter is mounted on the well head J, to achieve the same function as the preferred form A of the piston assembly.

The second alternate form A-2 of the piston assembly includes four rigid arcuate segments Q as may be seen in FIG. 18 that encircle the end section 18 and are so held within the confines of a first force rigid receiving generally cylindrical shell R that is mounted on the end section, with the first shell R being in threaded engagement with a second generally cylindrical force receiving shell S.

A group of first packing rings 300 disposed below the first force receiving shell R may be radially expanded into sealing contact with the end section 18 by use of a first force transmitting ring T. A second group of packing rings 302 is supported on the second force receiving cylindrical shell S and may be radially expanded into sealing contact with the interior surface 98 of expansion spool K by use of a second force transmitting ring U.

Each of the four arcuate slip segments Q as shown in FIG. 18 include a flat upper end surface 304, and a first cam surface 306 of frusto-conical shape defined on the exterior surface thereof. The first cam surface 306 extends downwardly and inwardly. Each slip segment Q includes a lower end surface 308. Each of the slip segments Q has an interior serated surface 310 that may be forced into gripping contact with the exterior surface 22 of casing end section 18.

The first force receiving cylindrical shell R is formed from steel or the like and includes an outer cylindrical surface 312 of slightly smaller diameter than the diameter of the surface 98 in expansion spool K. The shell R includes a lower end surface 314 from which a number of circumferentially spaced tapped recesses 316 extend upwardly into the shell. The first force receiving shell R has a lower interior cylindrical surface 318 that has a diameter slightly larger than the diameter of surface 22 of the end section 18 of casing H. The first force receiving shell R has a second cam surface 320 of frusto-conical shape defined on the interior thereof as may be seen in both FIGS. 21 and 22 with the cam surface on the upper end developing into a cylindrical surface 322 that has a circumferentially extending recess 324 therein. The upper interior portion of the first force receiving shell R has first threads 326 defined thereon. The first force receiving shell R has an upper ring shaped end surface 328.

The second force receiving cylindrical shell S includes an upper end surface 330 in which a number of circumferentially spaced tapped recesses 332 extend downwardly therefrom, and a shell also including an upper cylindrical surface, a lower cylindrical surface 336 that has second threads 338 defined thereon, with the upper and lower cylindrical surfaces being separated by an outwardly extending circular rib 340. The circular rib 340 has an external diameter slightly less than the diameter of the cylindrical surface 98 in the expansion spool K. Also, the rib 340 has a number of circumferentially spaced wrench engageable cavities 342 defined therein. The second force receiving shell S has a recess lower end surface 344 that removably engages the upper end portion of the end section 18 of casing H. Second force receiving shell S has the cylindrical interior surface 346.

Figure 22:
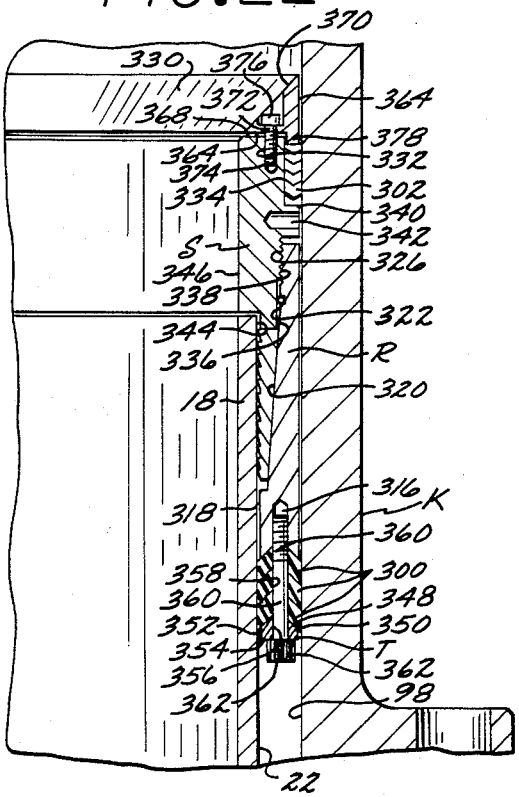
FIG. 22 is a longitudinal cross sectional view of the expansion spool and the second alternate form of piston assembly taken on the line 22—22 of FIG. 20.

The first force transmitting ring T is formed from steel or the like and has an upper end surface 348 as may best be seen in FIG. 22, an outer cylindrical surface 350 that is of slightly less diameter than the diameter of the surface 98 in expansion spool K and an inner cylindrical surface 352 that is of slightly greater diameter than the diameter of the surface 22 of end section 18 of casing H. The first force receiving ring T includes a bottom surface 354 from which a number of circumferentially spaced bores 356 extend upwardly through the first force receiving ring.

Figure 21:
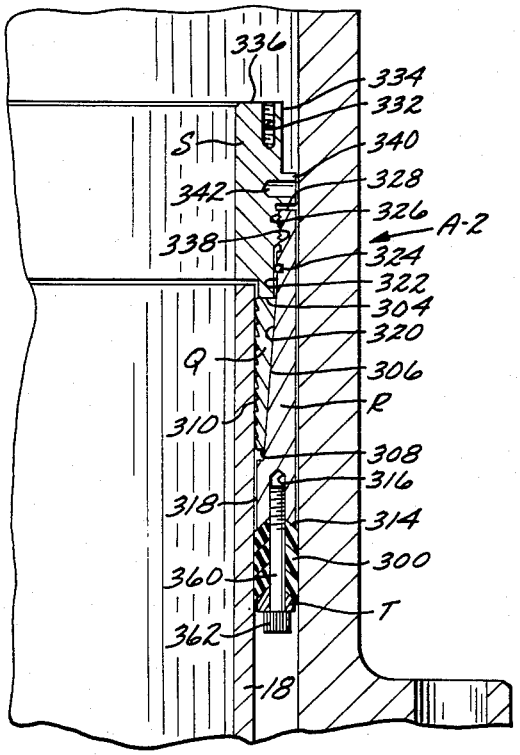
FIG. 21 is a longitudinal cross sectional view of the piston assembly and expansion spool taken on the line 21—21 of FIG. 19.

The first packing rings 300 are illustrated as being defined by a number of chevron type high temperature resisting packing rings that are disposed above the first force receiving ring T as shown in FIG. 22 and the lower end surface 314. The first packing rings 300 have bores 358 that are circumferentially spaced extending upwardly therethrough, and are axially alignable with the bores 356 in the first force transmitting ring T. A number of screws 360 extend upwardly through the bores 356 and 358 to threadedly engage the tapped recesses 316. The screws 360 include heads 362 that bear against the lower surface 354 of first force transmitting ring T as shown in FIG. 22. By rotating the screws 360 in an appropriate direction the packing rings 300 may be compressed longitudinally and radially expanded into sealing contact with the exterior surface 22 of end section 18. When the expansion spool K is disposed over the end section 18 as shown in FIGS. 21 and 22, the first packing rings 300 will also be in slidable pressure sealing contact with the interior surface 98 thereof. The recess 32*a* shown in FIG. 21 has a resilient ring 325 therein to effect a seal between the first and second force receiving rings.

The second packing rings 302 encircle the upper exterior portion of the second force receiving cylindrical shell S and rest on the upper surface of the circular rib 340. The second force transmitting ring U is formed from steel or the like and includes an outer cylindrical surface 364 of slightly smaller diameter than the diameter of the surface 98 defined in the expansion spool K, and the ring also including a bottom surface 366. The second force transmitting ring U includes an interior cylindrical surface 368 and an upwardly tapered upper end surface 370 from which a number of circumferentially spaced bores 372 extend downwardly through the ring.

The bores 372 are axially aligned with the tapped recesses 334. Screws 374 extend downwardly through the bores 372 to engage tapped recesses 332 formed in the second force receiving shell S. By rotating the screws 374 in an appropriate direction the heads 376 thereof are brought into bearing contact with the second force transmitting ring U to move the latter downwardly for a cylindrical rib 378 that extends downwardly therefrom to pressure contact the second packing ring 302. The second packing ring 302 when so pressure contacted is expanded radially into pressure sealing contact of a desired magnitude with the interior surface 98 of the expansion spool K, and the cylindrical surface 334. The seal may be effected after the second alternate form A-2 of the piston assembly is disposed within the expansion spool K. The second alternate form A-2 of the piston assembly serves the same function as the preferred form A, and like the preferred form the first and second packing rings 300 and 302 may be independently adjusted to exert a desired sealing pressure.

Figure 23:
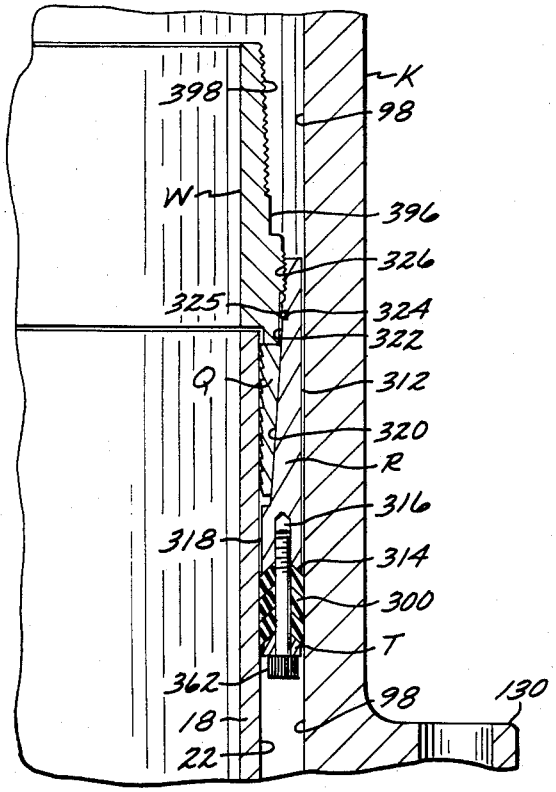
FIG. 23 is a longitudinal cross sectional view of a modified form of the second alternate form of piston assembly that includes an externally threaded adapter secured to the upper portion thereof.
Figure 24:
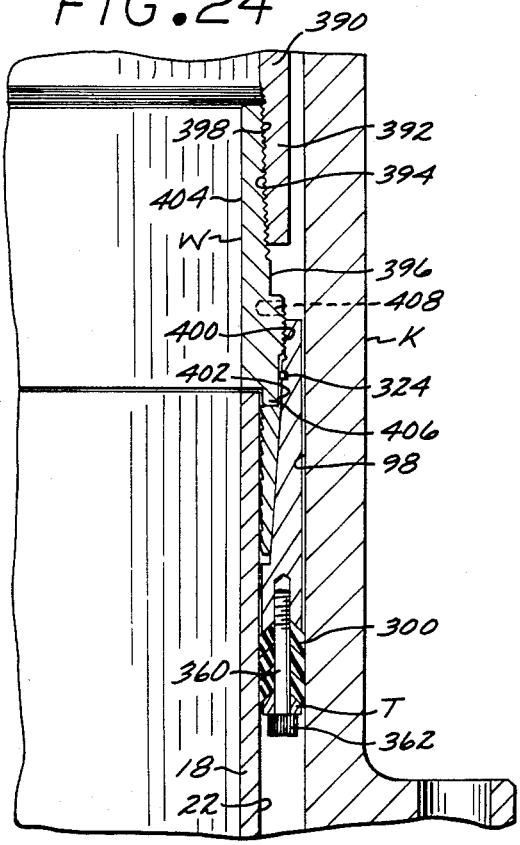
FIG. 24 is the same view as shown in FIG. 23 but with an internally threaded member secured to the adapter.

Upon occasions it may be desired to secure a tubular member 390 as shown in FIG. 24, having a lower end portion 392 that has internal threads 394 thereon in communication with the casing H while maintaining the second alternate form of piston assembly A-2 in sealing contact with the interior surface 98 of the expansion spool K. This result may be achieved by removing the second force receiving cylindrical shell S and second force transmitting shell U from the assembly. In that situation the second force receiving cylindrical shell S and second force transmitting ring U is eliminated and replaced by the tubular adapter W as shown in FIG. 23. Tubular adapter W has an external surface 396 which on the upper portion thereof has threads 398 that engage the threads 394 of tubular member 390 as shown in FIG. 24.

The adapter W has external threads 400 on the lower portion thereof that engage the threads 326 of the first force receiving cylindrical shell R. The adapter includes a cylindrical surface 402 below the threads 400 that is sealingly engaged by a resilient O ring 325 disposed in the recess 324. The adapter W has a bore 404 extending longitudinally therethrough that places the interior of the casing section 18 in communication with the interior of the tubular member 390. The adapter includes a downwardly extending circular rib 406 that contacts the upper end surfaces of the slip segments Q. The adapter W may be rotated relative to the first force receiving cylindrical shell R by wrench engaging recesses 408 formed in the adapter as shown in FIG. 24.

The use and operation of the referred and alternate forms of the piston assembly have been described previously in detail and need not be repeated.

What is claimed is:

1. In a geothermal well that includes a well head through which a smooth external surfaced production casing that is anchored at the bottom extends upwardly for an end section of said production casing to be disposed above said well head, said section contracting and expanding longitudinally due to variations in temperature of said well, an expansion spool disposed above said well head, said expansion spool defining an upwardly extending smooth surfaced cylindrical passage of greater diameter than the external diameter of said end section and that extends completely around said end section when said expansion spool is mounted on said well head and secured thereto, the combination with said end section of a piston assembly removably mounted thereon that so supports packing that said packing may be manually adjusted to exert a sealing pressure of a desired magnitude on said cylindrical surface after a major portion of said piston assembly is in said passage and prior to said expansion spool being lowered onto said well head and secured thereto, said piston assembly including:

a. circumferentially extending mounting means that may be slid downwardly on said smooth external surfaced end section to a desired position thereon above said well head;

b. first means for removably securing said mounting means to said smooth external surfaced end section at said desired position;

c. first ring shaped resilient packing means that encircle said smooth external surfaced end section and are in abutting contact with said mounting means;

d. second means that are wrench operable and form a part of said piston assembly for longitudinally compressing said first packing means and radially deforming same into pressure sealing contact of a desired magnitude with said smooth external surfaced end section and said mounting means;

e. second ring shaped resilient packing means that encircle said smooth external surfaced end section and are disposed in abutting contact with said mounting means and having an external surface slightly smaller than that of said cylindrical passage; and f. third means that form a part of said piston assembly that are wrench operable for longitudinally compressing said second packing means and radially deforming the same into pressure sealing contact of a desired magnitude with a portion of said expansion spool that defines said cylindrical passage and with said mounting means when at least a major portion of said piston assembly is within said cylindrical passage in said expansion spool.

2. A piston assembly as defined in claim 1 in which said mounting means is an interior first force receiving generally cylindrical shell that extends around said end section and an exterior second force transmitting generally cylindrical shell that extends around said first cylindrical shell, said first and second cylindrical shells including first and second threads that are in rotatable engagement, and said first means including:

g. first and second cam surfaces on said first and second first and second generally cylindrical shells, said first and second cam surfaces in slidable and rotational engagement;

h. a plurality of protrusions on at least a portion of the surface of said first generally cylindrical shell most adjacent said end section; and i. wrench engageable means for rotating said second generally cylindrical shell relative to said first generally cylindrical shell in a direction that as said second cam surface moves relative to said first cam surface in an appropriate direction said second generally cylindrical shell forces said protrusions and the portion of said first cylindrical shell on which they are defined inwardly for said protrusions to removably grip said end section.

3. A piston assembly as defined in claim 2 in which said first generally cylindrical shell includes a lower portion that has internal and external threads thereon, a first circular rib that extends inwardly from said first generally cylindrical shell and is disposed a substantial distance above said internal threads, said first resilient packing means encircling said first generally cylindrical shell between said first rib and interior threads, and said second means including:

j. a first force transmitting rigid ring that movably encircles said end section and has a flat upper surface and an exterior surface on which second threads are defined that engage said interior threads; and k. first wrench engageable means on said first force transmitting ring for rotating the latter in a direction that it moves upwardly for said upper surface to exert a compressive force on said first resilient packing means to radially deform the latter into pressure sealing contact with said end section and said first generally cylindrical shell.

4. A piston assembly as defined in claim 3 in which said first generally cylindrical shell includes a second circular rib that extends outwardly therefrom and is situated a substantial distance above said external threads, said second resilient packing means encircling said first generally cylindrical shell between said second rib and external threads, and said third means including:

l. a second force transmitting rigid ring that rotatably encircles said first generally cylindrical shell, and that includes an upper end surface and an interior surface on which third threads are defined that engage said exterior threads; and m. second wrench engageable means on said second force transmitting ring that are accessible when said second packing means are within said passage of said expansion spool, said second force transmitting ring when rotated in an appropriate direction moving upwardly relative to said first generally cylindrical shell for said end surface to exert a longitudinally directed upper force on said second packing means to radially deform the later into pressure sealing contact with said cylindrical surface and said first generally cylindrical shell with a desired magnitude of force.

5. A piston assembly as defined in claim 2 in which said second generally cylindrical shell and first generally cylindrical shell include adjoining side surfaces in which circumferentially extending recesses are defined that cooperate to provide an annulus space, and a transverse tapped passage in said first generally cylindrical shell in communication with said annulus space, said passage permitting a high temperature resisting jelly like grease to be discharged into said annulus space to provide a seal therein; and j. an externally threaded plug that removably engages said tapped passage to prevent escape of grease from said annulus space.

6. A piston assembly as defined in claim 1 in which said mounting means is a rigid force receiving ring that encircles said end section and has a central portion that has a top surface, a cylindrical shell that extends upwardly from said central portion and cooperates with said casing end section and said cylindrical surface of said expansion spool to define inner and outer annulus spaces in which said first and second ring shaped packing means are disposed, said mounting means including engageable means that depend from said central portion, and said first means including:

g. a clamping ring that encircles said end section and removably grips the latter; and h. engaging means that extend upwardly from said clamping ring and removably engage said engageable means to support said mounting means at a fixed position on said end section.

7. A piston assembly as defined in claim 6 in which said cylindrical shell includes an interior surface that has an upper portion on which first threads are defined and said second means is:

i. a first force transmitting rigid ring that encircles said end section and has an interior surface on which second threads are defined that are in engagement with said first threads, and said first force transmitting ring including a lower end surface and an upper end surface; and j. wrench engageable means on said upper end surface for rotating said first force transmitting ring, with said first transmitting ring when rotated in an appropriate direction moving downwardly for said lower end surface to exert a compressive force on said first packing means to radially deform the latter into pressure sealing contact with said end section and said mounting means.

8. A piston assembly as defined in claim 7 in which said cylindrical shell of said mounting means includes a top end surface that has a plurality of circumferentially spaced tapped cavities extending downwardly therefrom into said cylindrical shell of said mounting means and said third means is:

k. a second force transmitting rigid ring disposed above said mounting means, said second ring having a plurality of circumferentially spaced openings extending downwardly therethrough, said second ring including a cylindrical rib projecting downwardly therefrom, said cylindrical rib including a lower end surface in contact with said second packing means; and l. a plurality of screws that have heads, said screws extending downwardly through said openings to engage said tapped cavities, said screws when rotated in an appropriate direction having said heads contact said second ring to force the latter downwardly for said cylindrical rib to exert a compressive force on said second packing means to radially deform the latter into pressure sealing contact with said cylindrical shell of said mounting means and said cylindrical surface of said expansion spool.

9. A piston assembly as defined in claim 1 in which said mounting means is a first force receiving cylindrical shell that encircles said end piece and has a lower end surface, an interior surface that has a lower portion that defines a first cam surface and an upper portion that defines first threads, said lower end surface having a plurality of circumferentially spaced cavities extending upwardly therefrom; and a second force receiving shell disposed above said end section that has second threads thereon that rotatably engage said first threads and a circular rib that extends downwardly from said second force receiving shell, said second force receiving shell including an outer surface on which wrench engageable means are defined for rotating said second force receiving shell relative to said first force receiving shell and said means are:

g. a plurality of arcuate slip segments that encircle said end section, each of said segments including inner and outer side surfaces and a top end surface, a plurality of protuberances that project from each of said inner surfaces and each of said outer surfaces defining a second cam surface in sliding contact with said first cam surface, with said circular rib of said second force receiving shell in abutting contact with said top end surfaces of said slip segments, with said second force receiving shell when rotated in an appropriate direction moving said first force receiving shell upwardly relative to said slip segments to move the latter inwardly and force said protuberances into gripping contact with said end section and support said mounting means at a fixed position thereon.

10. A piston assembly as defined in claim 9 in which said first ring shaped resilient packing means encircles said end piece below said first force receiving ring and has a plurality of circumferentially spaced openings that textend upwardly therethrough and are aligned with said tapped cavities and said second means is:

h. a first force transmitting ring that encircles said end piece below said first packing means, said first ring having a plurality of circumferentially spaced openings therein that are vertically aligned with said openings in said first force receiving ring; and i. a plurality of screws that have heads, said screws extending upwardly through said openings in said first packing means and said first force receiving ring to engage said tapped cavities, with said screws when rotated in an appropriate direction moving said first force transmitting ring upwardly to compress said first packing means and radially deform the latter into pressure sealing contact with said end section and said cylindrical surface of said expansion spool.

11. A piston assembly as defined in claim 10 in which said second force receiving shell includes a circular rib that extends outwardly from said outer surface thereof, said rib, said cylindrical surface of said expansion spool and said second force receiving shell cooperating to define an annulus space in which said second ring shaped packing means is disposed, said second force receiving shell including an upper end surface from which a plurality of tapped cavities extend downwardly, and said third means is :

j. a second force transmitting ring disposed above said second force receiving shell, said second shell having a plurality of spaced openings therein that are vertically aligned with said tapped cavities, and said second shell including a circular downwardly extending rib that contact said second resilient packing means in said annulus space; and k. a plurality of screws that have heads, said screws extending downwardly through said openings in said second shell to engage said tapped cavities, and said screws when rotated in an appropriate direction having the heads thereof contact said second shell and force the latter downwardly for said circular rib to compress said second packing means and radially deform the same into pressure sealing contact with said cylindrical surface of said expansion spool and exterior surface of said second force receiving ring.

12. A piston assembly as defined in claim 11 which in addition includes a tubular adapter and a tubular member that includes a first threaded end portion, said tubular member extending downwardly in said passage in said expansion spool, said tubular adapter including upper and lower end portions, said lower portion including third threads that removably engage said second threads when said second force receiving shell and second force transmitting shell are removed from said piston assembly together with said screws associated therewith, said lower portion including a downwardly extending circular rib, and said adapter including wrench engageable means for rotating it in an appropriate direction relative to said first force receiving ring to dispose said circular rib in abutting contact with said slip segments, with said upper portion including fourth threads that are removably engaged by said first threaded end of said tubular member, with said tubular adapter cooperating with said piston assembly to establish communication between said casing end section and said tubular member.

* * * * *